US005508790A

United States Patent [19]

Belinkov et al.

[11] Patent Number: 5,508,790

[45] Date of Patent: Apr. 16, 1996

[54] PHOTORECEPTOR SHEET AND IMAGING SYSTEM UTILIZING SAME

[75] Inventors: Haim Belinkov, Rishon Le Zion; Alon Gazit, Nes Ziona; Ilan Kander, Ranaana; Yakov Krumberg, Rehovot; Ilan Meiri, Yavne; Yehuda Niv, Nes Ziona; Ami Shiff, Yavne; Shlomo Yitzhaik, Rishon Le Zion, all of Israel

[73] Assignee: Indigo N.V., Veldhoven, Netherlands

[21] Appl. No.: 301,775

[22] Filed: Sep. 7, 1994

[51] Int. Cl.[6] ..... G03G 5/00;

[52] U.S. Cl. ..... 355/211

[58] Field of Search ..... 355/211–213; 430/66, 67, 69

[56] References Cited

U.S. PATENT DOCUMENTS

| | | | |
|---|---|---|---|
| 3,639,121 | 1/1972 | York | 96/1.5 |
| 3,773,416 | 11/1973 | Kushima | 355/277 |
| 3,783,021 | 1/1974 | York | 117/212 |
| 3,941,472 | 3/1976 | Nagahara et al. | 355/213 |
| 4,165,169 | 8/1979 | Miyashita et al. | 355/211 |
| 4,378,416 | 3/1983 | Yanagawa et al. | 430/56 |
| 4,758,486 | 7/1988 | Yamazaki et al. | 430/56 |
| 4,877,198 | 10/1989 | Gershenson et al. | 355/212 X |
| 5,228,361 | 6/1993 | Mishra | 430/58 |
| 5,255,056 | 10/1993 | Preszler et al. | 355/211 |

FOREIGN PATENT DOCUMENTS

| | | |
|---|---|---|
| 2116064 | 7/1972 | France . |
| 2009346 | 9/1970 | Germany . |
| 2746065 | 4/1979 | Germany . |
| 3514809 | 10/1985 | Germany . |
| 2080566 | 2/1982 | United Kingdom . |
| 91/17485 | 11/1991 | WIPO . |

OTHER PUBLICATIONS

International Search Report and Annex.

*Primary Examiner*—William J. Royer
*Attorney, Agent, or Firm*—Greenblum & Bernstein

[57] ABSTRACT

An imaging apparatus incorporating a substantially rectangular organic photoreceptor sheet having a base layer, a conductive layer and a photoconductive layer, wherein along one edge of the photoreceptor sheet there is an exposed conductive area, a drum having a longitudinal cavity formed therein and including a slot formed between the cavity and the cylindrical surface of the drum into which the one edge of the photoreceptor sheet is inserted and a rotatable element within the cavity which, in a locking position, presses the photoreceptor sheet against a wall of the cavity, fixedly and removably holding the photoreceptor sheet in place.

33 Claims, 3 Drawing Sheets

FIG. 1A
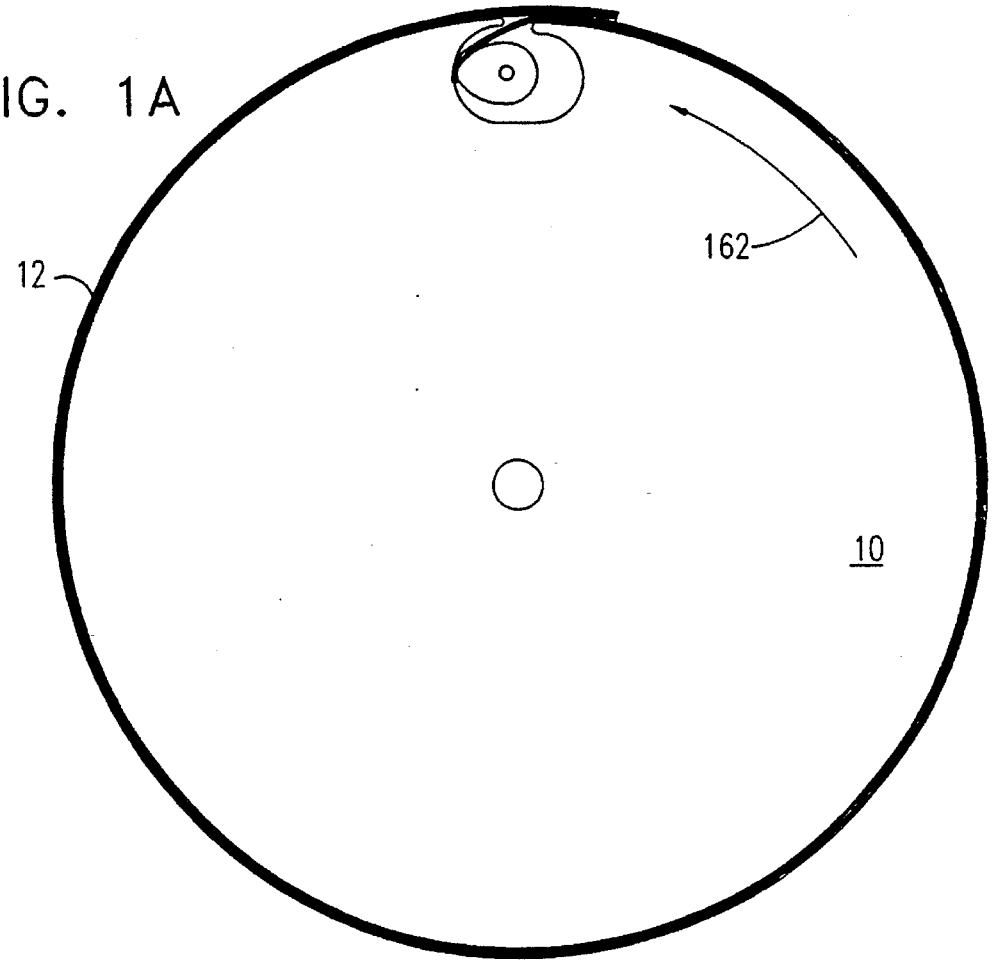
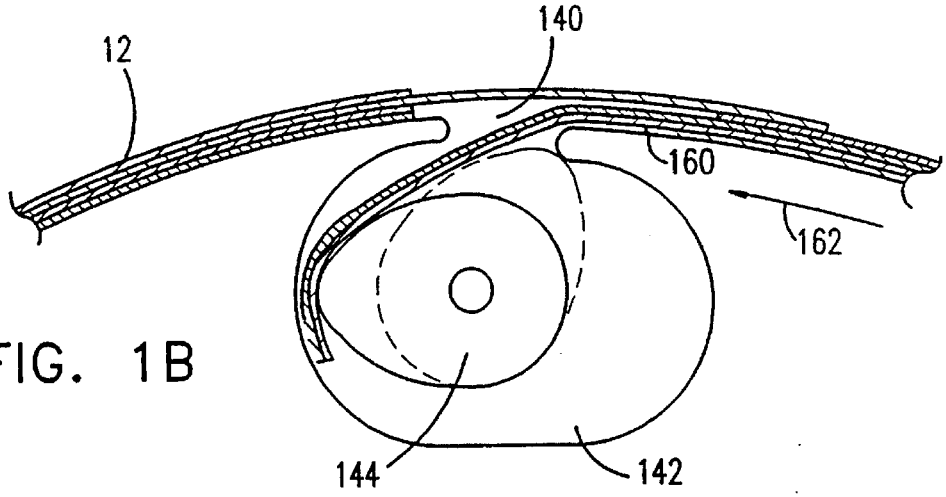
FIG. 1B

PHOTORECEPTOR SHEET AND IMAGING SYSTEM UTILIZING SAME

FIELD OF THE INVENTION

The present invention relates to image forming and image transfer apparatus especially for use in electrostatic imaging using a sheet type photoreceptor.

BACKGROUND OF THE INVENTION

Organic photoreceptor materials for use in toner imaging are well known. In some systems the organic photoreceptor is coated onto a drum or endless belt on which an electrostatic image is formed. In other systems a sheet of photoreceptor material is mounted onto a drum to provide the same function.

SUMMARY OF THE INVENTION

The present invention seeks to provide, in a first aspect thereof, an improved image forming apparatus utilizing a new sheet photoreceptor configuration.

The present invention further seeks to provide, in a second aspect thereof, an improved sheet photoreceptor for use in such apparatus.

There is thus provided, in accordance with a preferred embodiment of the invention an imaging apparatus comprising:

a substantially rectangular organic photoreceptor sheet comprising a base layer, a conductive layer and a photoconductive layer, wherein along one edge of the sheet there is an exposed conductive area, preferably an exposed portion of the conductive layer;

a drum having a longitudinal cavity formed therein and including a slot formed between the cavity and the cylindrical surface of the drum into which the one edge of the photoreceptor sheet is inserted; and a rotatable element within the cavity which, in a locking position, presses the sheet, and preferably the conductive area thereof against a wall of the cavity, fixedly and removably holding the photoreceptor sheet in place.

Alternatively, the conductive area is pressed against the rotatable element.

In a preferred embodiment of the invention, the drum is at substantially ground electrical potential.

In a preferred embodiment of the invention on a portion of the photoreceptor sheet, along a second edge thereof opposite the one edge, both the photoconductive and conductive layers are not present and wherein said portion of the photoreceptor sheet overlies the slot.

Preferably, the chargeable photoreceptor comprises a dust masking layer, preferably of paper, between the base layer and the drum. Preferably, the dust masking layer is attached to the base layer only along an edge of the paper layer, preferably adjacent to the slot.

There is further provided, in accordance with a preferred embodiment of the invention, a substantially rectangular organic photoreceptor sheet comprising a base layer, a conductive layer and a photoconductive layer wherein along one edge thereof the photoconductive layer is not present such that the conductive layer is exposed.

There is further provided, in accordance with a preferred embodiment of the invention, a substantially rectangular organic photoreceptor sheet comprising a base layer, a conductive layer and a photoconductive layer wherein along one edge thereof there is an exposed conductive area.

Preferably, along a second edge opposite the one edge, both the photoconductive and conductive layers are not present.

Preferably the photoreceptor sheet comprises a dust masking layer, preferably of paper, proximate the base layer. Preferably, the dust masking layer is attached to the base layer only along an edge of the dust masking layer, preferably adjacent to exposed conductive edge.

There is further provided, in accordance with a preferred embodiment of the invention, a substantially rectangular organic photoreceptor sheet comprising a base layer, a conductive layer and a photoconductive layer wherein along one edge thereof the photoconductive layer and the conductive layers are not present.

Preferably the photoreceptor sheet comprises a dust masking layer, preferably of paper, proximate the base layer. Preferably, the dust masking layer is attached to the base layer only along an edge of the dust masking layer. Preferably the dust masking layer is attached adjacent to and displaced from an edge of the photoreceptor opposite the one edge thereof at which the photoconductive layer and the conductive layers are not present.

There is further provided, in accordance with a preferred embodiment of the invention, a substantially rectangular organic photoreceptor sheet comprising a base layer, a conductive layer and a photoconductive layer and further comprising a dust masking layer, preferably a paper layer, proximate the base layer.

Preferably, the dust masking layer is attached to the base layer only along an edge of the dust masking layer, preferably, adjacent to and displaced from an edge of the photoreceptor.

BRIEF DESCRIPTION OF THE DRAWINGS

The present invention will be understood and appreciated more fully from the following detailed description, taken in conjunction with the drawings in which:

FIG. 1A and 1B are cross-sectional, simplified, overall and expanded, partial drawings, respectively of a drum on which a photoreceptor is mounted, showing a mounting method for photoreceptors in accordance with a preferred embodiment of the invention;

DETAILED DESCRIPTION OF PREFERRED EMBODIMENTS

Figure 1C:
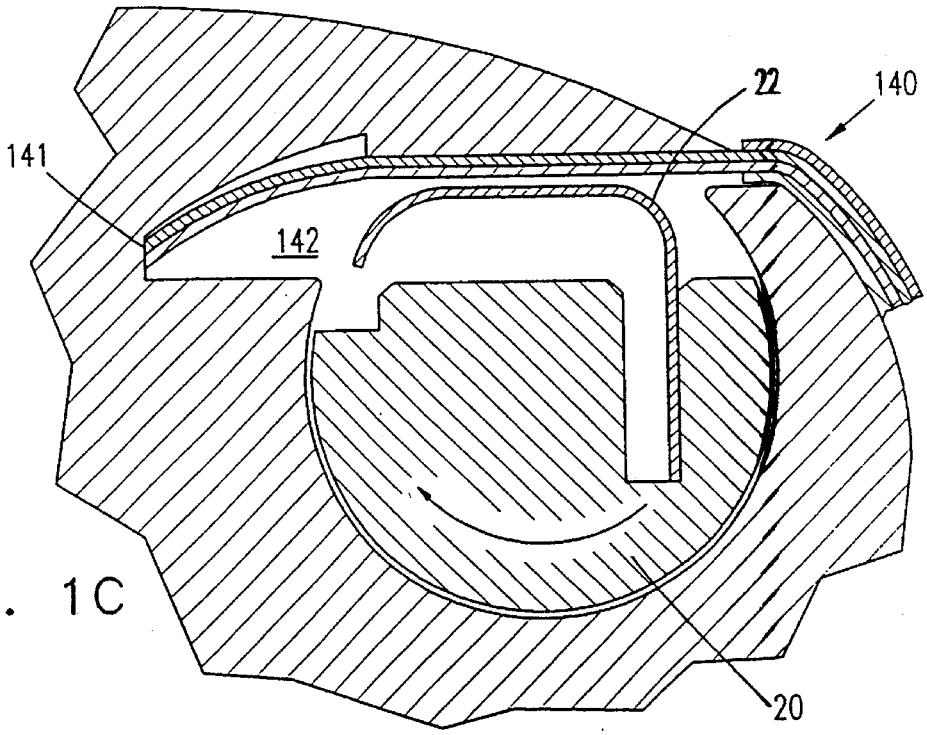
FIGS. 1C and 1D show an alternative method for mounting photoreceptors in respective open and gripping configurations.

A novel photoreceptor sheet 12 and an apparatus and method for mounting the sheet on a drum 10 are shown in FIGS. 1A, 1B and 2A–2D.

Photoreceptor sheet 12 is preferably mounted on drum 10 using the mechanisms shown in FIGS. 1A and 1B or 1C and 1D. As shown most clearly in FIG. 1B, one end of photoconductive sheet is inserted into a slot 140 which forms the entryway to a cavity 142 formed in drum 10. An eccentric cylindrical cam 144 which is situated in the cavity can be rotated to one of two positions. With the cam in a first position shown by dotted lines in FIG. 1B, the photoreceptor sheet can be inserted into the slot and between the cam and a wall of cavity 142. After the photoreceptor sheet is in the position shown in FIG. 1B, cam 144 is rotated to the position shown by the solid lines, thereby pressing the cam against the photoreceptor sheet and holding it in position on the drum.

Figure 1D:
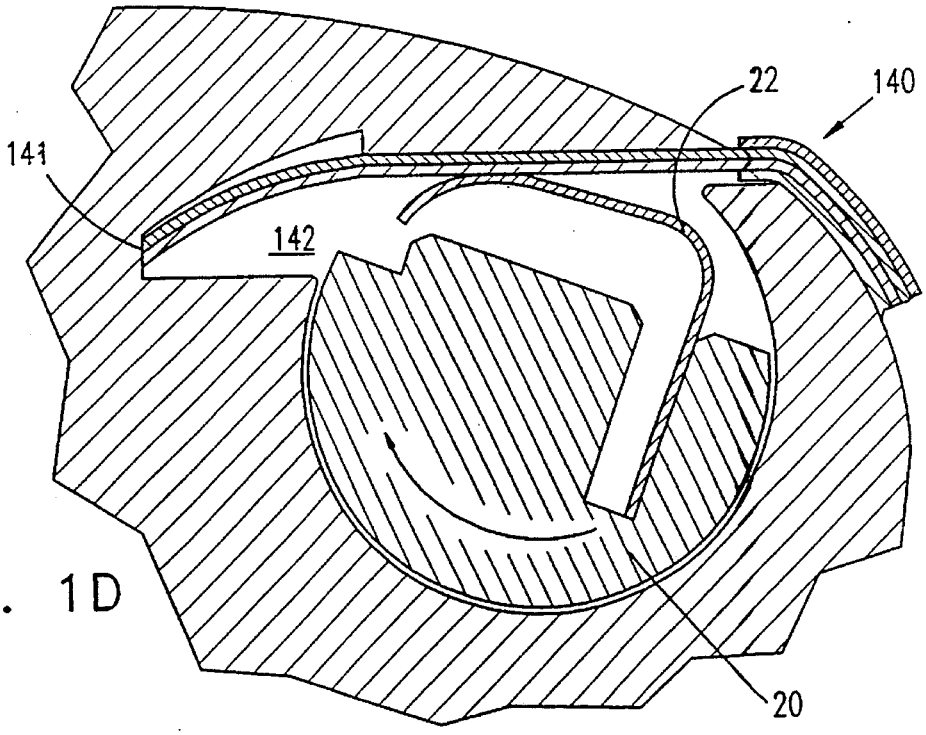

FIGS. 1C and 1D show a rotating member 20 having a resilient element 22, such as a row of spring fingers attached thereto and facing toward the outside of the drum. When the rotating member is in an open position as shown in FIG. 1C, the photoreceptor sheet can be inserted into slot 140 past resilient element 22. Preferably, the resilient element guides the inserted end of the photoreceptor sheet to position 141 which acts to assure that the photoreceptor sheet is positioned without skew relative to the rotating direction.

When the rotating element is turned as shown in FIG. 1D the resilient fingers press against the photoreceptor sheet and hold it firmly against the outer wall of cavity 142.

A preferred embodiment of the photoreceptor sheet 12 which is especially suitable for mounting in accordance with the method illustrated in FIGS. 1A to 1D is shown in FIGS. 2A–2D.

Photoreceptor sheet 12 consists essentially of an especially configured photoreceptor and an attached sheet of paper or other dust encasing material such as rubber. As shown most clearly in FIGS. 2B–2D, a central portion 150 of photoreceptor sheet 12 comprises four layers, a paper layer 151, which is shown bottommost on the Figs. and is in contact with drum 10, a backing layer 152, such as of Mylar or the like adjacent to the paper layer, preferably attached thereto and preferably not attached thereto over its entire surface, a conducting layer 154 overlying the base layer and a photoconductive layer 156 overlying the conducting layer. In general the photoconductive layer comprises a charge transport layer and a charge generation layer; however, these are referred to herein as a "photoconductive layer" for simplicity of the discussion, since the exact construction of the photoconductive layer or layers does not form a part of the present invention. A preferred photoreceptor is Emerald 2 (manufactured by Lexmark). To improve compatibility of the photoreceptor sheet when it is used with liquid toner, the photoreceptor sheet should preferably be treated by one of the treatments specified in PCT publication WO 91/17485 which corresponds to copending U.S. application 07/946,411, the disclosure of which is incorporated by reference.

In general these applications describe several processes. In one process, the photoreceptor sheet is mounted on a drum with the photoconductive surface facing outwards. The sheet is subjected to heat treatment which removes stress from the photoconductive layer without removing it from the backing layer. The photoreceptor sheet is now cooled, without removing it from the drum. When the photoreceptor sheet is removed from the drum, the photoconductive layer is in compression and the backing layer is in tension.

In a second process the photoreceptor sheet is subjected to tension and heated to a temperature at which the photoconductive layer is stress released but at which the base is not stress released. The photoreceptor sheet is cooled and then the tension is removed. This process also results in a photoreceptor sheet in which the photoconductive layer is in compression and the base layer is in tension.

In a third process the surface of the photoconductive layer is chemically treated to remove stress from the photoconductive layer and make it more plastic or elastic than it previously was. Preferably materials such as cyclohexanone are used to chemically treat the photoconductive layer.

What should be noted in FIGS. 1B–1D is that not all of the layers extend to the ends of photoreceptor sheet 12. In particular, the end of the sheet which is inserted into slot 140 (the "leading edge" of the sheet), as shown in FIGS. 1B–1D, has only two layers, i.e., backing layer 152 and conducting layer 154. This assures that the conducting layer, when, pressed against the interior of cavity 142 by cam 144 or element 22, will make good electrical contact with the cavity wall. This provides convenient grounding of the conductive layer, even when the backing layer and the paper layer are not conducting.

Alternatively, the photoreceptor sheet can be provided with a conductive edge which is electrically connected with the conductive layer and either the cavity wall or resilient element 22, or both.

The paper layer, as indicated above, is not attached to the back of the backing layer over the length of the photoreceptor sheet. However, in a preferred embodiment of the invention, the paper is attached to the backing layer near the leading edge of the photoreceptor sheet and at the end of the paper, i.e., at reference numeral 158. The function of the paper layer is to reduce the effect of dust or other particles which may be on the drum (or possibly between the photoconductive layer and the paper) from effecting the imaging process by causing pressure points on the surface of the photoreceptor sheet. The optimum thickness of the paper layer has been found, for the particular photoreceptor sheet described above, to be between about 50 micrometers and 300 micrometers and a soft, open weave paper such as Nordland Woodtree uncoated white bond printing paper (120 g/m$^2$,≈150 micrometers thick, manufactured by Nordland, Germany) is preferred.

Figure 2A:
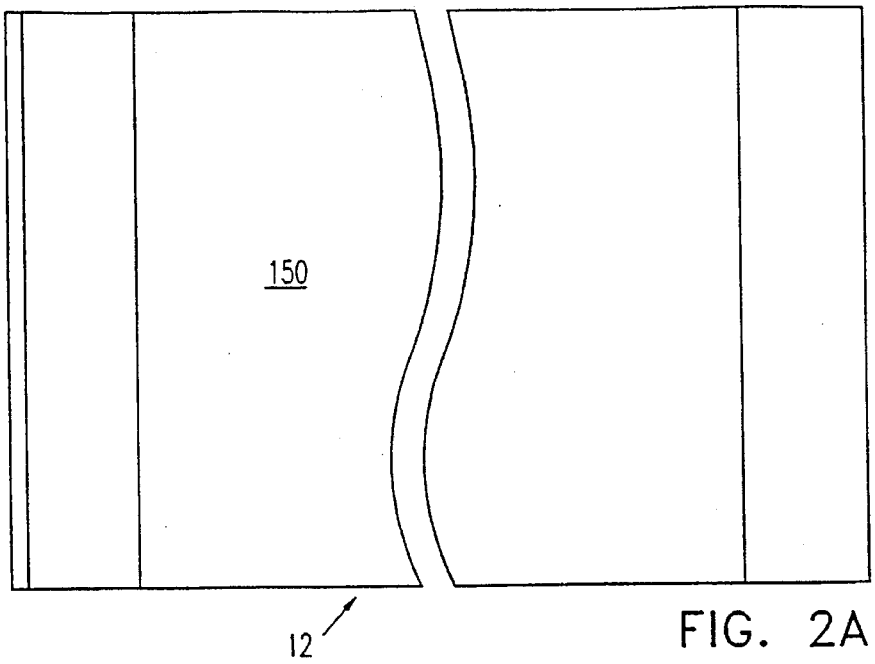
FIG. 2A and 2B are respective top and side views of a photoreceptor in accordance with a preferred embodiment of the invention.
Figure 2B:
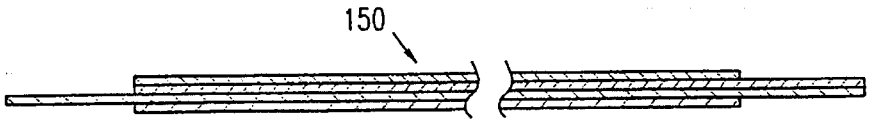
Figure 2C:
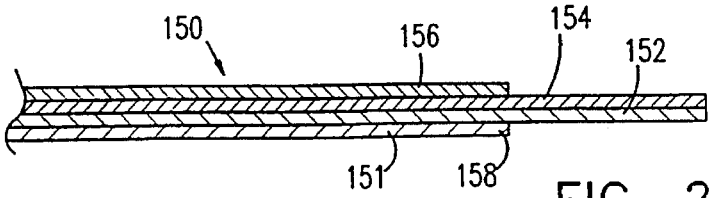
FIGS. 2C and 2D are cross-sectional partial side views of the photoreceptor of FIGS. 2A and 2B.
Figure 2D:
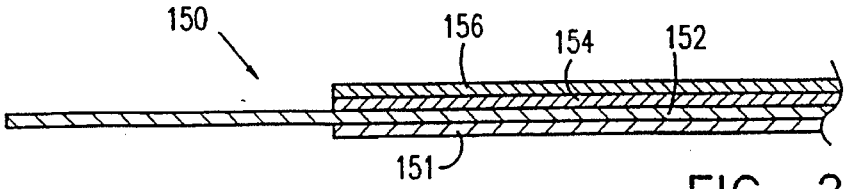

The other end of the photoconductive layer (its trailing edge), which is shown in detail in FIG. 2D preferably comprises only the backing layer, and, as shown in FIGS. 1B–1D, the backing layer extends long enough to overlay slot 140 so as to avoid liquid toner entering cavity 142. Further, the outer surface of drum 10 is shaped near slot 140 (at reference numeral 160) to provide a slope so that the contact between the photoreceptor sheet and surfaces which it contacts is smooth, i.e., such that the overall diameter of the drum and the photoreceptor sheet and, if present, the overlaying trailing edge, remains independent of the angular position on the drum.

All the layers other than the backing layer are removed at the trailing edge mainly to obviate any chance that the a conducting surface will touch a charging device such as a scorotron.

Finally, if the photoreceptor sheet is pressed against another surface, the trailing edge of the photoreceptor sheet is cut at a slight angle to square, of about 1 in 35. This angle is used to provide a smooth transition of contact, at the edge, for a cleaner blade, used to clean untransferred toner from the photoreceptor sheet, prior to the next imaging cycle. A photoreceptor sheet having square cut ends or having one or both edges cut at a slight angle is referred to herein as a "substantially rectangular" photoreceptor sheet. All edges and transitions are preferably smooth without jagged margins.

For clarity, the overlapping end of the photoreceptor sheet is not shown in FIGS. 1C and 1D.

The dimensions of the leading and trailing edges of the photoreceptor sheet can be varied to suit the particular application. The present inventors have found that the leading, conductive edge (inserted into slot 140) of the photoreceptor sheet is preferably about 13 mm wide and the trailing edge (for overlap) is preferably about 20 mm wide.

For reference the direction of rotation of drum 10 is shown by an arrow 162.

It will be appreciated by persons skilled in the art that the present invention is not limited by the description and example provided hereinabove. Rather, the scope of this invention is defined only by the claims which follow:

We claim:

1. Imaging apparatus comprising:

a substantially rectangular organic photoreceptor sheet comprising a base layer, a conductive layer and a photoconductive layer, wherein along one edge of the sheet there is an exposed conductive area;

a drum having a longitudinal cavity formed therein and including a slot formed between the cavity and the cylindrical surface of the drum into which the one edge of the photoreceptor sheet is inserted; and a rotatable element within the cavity which, in a locking position, presses the sheet against a wall of the cavity, fixedly and removably holding the photoreceptor sheet in place.

2. Imaging apparatus according to claim 1 wherein the conductive area is an exposed portion of the conductive layer, the photoconductive layer being absent.

3. Imaging apparatus according to claim 2 wherein the conductive area is pressed against the wall of the cavity.

4. Imaging apparatus according to claim 2 wherein the conductive area is pressed against the rotatable element.

5. Imaging apparatus according to claim 1 wherein the conductive area is pressed against the wall of the cavity.

6. Imaging apparatus according to claim 1 wherein the conductive area is pressed against the rotatable element.

7. Imaging apparatus according to claim 1 wherein the drum is at substantially ground electrical potential.

8. Imaging apparatus according to claim 1 wherein, on a portion of the photoreceptor sheet, along a second edge thereof opposite the one edge, both the photoconductive and conductive layers are not present and wherein said portion of the photoreceptor sheet overlies the slot.

9. Imaging apparatus according to claim 1 wherein the photoreceptor comprises a dust masking layer between the base layer and the drum.

10. Imaging apparatus according to claim 9 wherein the dust masking layer is a paper layer.

11. Imaging apparatus according to claim 10, wherein the paper layer is attached to the base layer only along an edge of the paper layer.

12. Imaging apparatus according to claim 11 wherein the paper layer is attached to the base layer adjacent to the slot.

13. Imaging apparatus according to claim 9, wherein the dust masking layer is attached to the base layer only along an edge of the dust masking layer.

14. A substantially rectangular organic photoreceptor sheet comprising a base layer, a conductive layer and a photoconductive layer wherein along one edge thereof the photoconductive layer is not present such that the conductive layer is exposed.

15. A photoreceptor sheet according to claim 14 wherein, along a second edge opposite the one edge, both the photoconductive and conductive layers are not present.

16. A photoreceptor sheet according to claim 14 and further comprising a dust masking layer proximate the base layer.

17. A photoreceptor sheet according to claim 16 wherein the dust masking layer is a paper layer.

18. A photoreceptor sheet according to claim 17 wherein the dust masking layer is attached adjacent to and displaced from an edge of the photoreceptor sheet.

19. A photoreceptor sheet according to claim 16 wherein the dust masking layer is attached to the base layer only along an edge of the dust masking layer.

20. A photoreceptor sheet according to claim 19 wherein the dust masking layer is attached adjacent to the one edge of the photoreceptor sheet having the conductive layer which is exposed.

21. A substantially rectangular organic photoreceptor sheet comprising a base layer, a conductive layer and a photoconductive layer wherein along one edge thereof there is an exposed conductive area.

22. A photoreceptor sheet according to claim 21 wherein, along a second edge opposite the one edge, both the photoconductive and conductive layers are not present.

23. A photoreceptor sheet according to claim 21 and further comprising a dust masking layer proximate the base layer.

24. A photoreceptor sheet according to claim 23 wherein the dust masking layer is a paper layer.

25. A photoreceptor sheet according to claim 23 wherein the dust masking layer is attached to the base layer only along an edge of the dust masking layer.

26. A photoreceptor sheet according to claim 25 wherein the dust masking layer is attached adjacent to the one edge of the photoreceptor sheet having the exposed conductive area.

27. A substantially rectangular organic photoreceptor sheet comprising a base layer, a conductive layer and a photoconductive layer wherein along one edge thereof the photoconductive layer and conductive layers are not present.

28. A photoreceptor sheet according to claim 27 and further comprising a dust masking layer proximate the base layer.

29. A photoreceptor sheet according to claim 28 wherein the dust masking layer is attached to the base layer only along an edge of the dust masking layer.

30. A photoreceptor sheet according to claim 29 wherein the dust masking layer is attached adjacent to and displaced from an edge of the photoreceptor sheet opposite the one edge thereof at which the photoconductive layer and conductive layers are not present.

31. A photoreceptor sheet according to claim 27 wherein the one edge forms an angle different from 90° with the adjoining edges of the photoreceptor sheet.

32. A photoreceptor sheet according to claim 28 wherein the dust masking layer comprises a paper layer.

33. A photoreceptor sheet according to claim 30 and further comprising a dust masking layer proximate the base layer, and wherein the dust masking layer is attached to the base layer only along an edge of the dust masking layer.

* * * * *